US006012669A

United States Patent [19]

Tharpe, Jr. et al.

[11] Patent Number: 6,012,669

[45] Date of Patent: Jan. 11, 2000

[54] APPARATUS FOR CONTROLLING TENSION IN A WEB OF FABRIC AND ASSOCIATED METHODS

[76] Inventors: John M. Tharpe, Jr.; Robert M. Herrin, both of 1005 Willie Pitts Jr. Rd., P.O. Box 3970, Albany, Ga. 31706

[21] Appl. No.: 09/089,775

[22] Filed: Jun. 3, 1998

[51] Int. Cl.[7] ..... B65H 20/32

[52] U.S. Cl. ..... 242/417.3; 242/417.2; 242/154; 226/118.3

[58] Field of Search ..... 242/417.3, 417.2, 242/154, 552; 226/118.3, 118.1, 118.2

[56] References Cited

U.S. PATENT DOCUMENTS

| | | | |
|---|---|---|---|
| 1,226,713 | 5/1917 | Smith | 242/417.2 |
| 1,946,264 | 2/1934 | Baer | 242/417.3 |
| 2,006,628 | 7/1935 | Cline | 242/417.3 |
| 2,357,389 | 9/1944 | Ferm | 226/118.2 X |
| 2,681,184 | 6/1954 | Thomas | 242/417.3 |
| 3,249,315 | 5/1966 | Peltier | 242/417.3 |
| 3,331,568 | 7/1967 | Okamura | 242/154 |
| 4,360,137 | 11/1982 | Noe et al. | 226/118.2 X |
| 4,609,336 | 9/1986 | Stevenson et al. | 242/417.3 X |
| 5,031,847 | 7/1991 | Tanaka | 242/417.3 |
| 5,411,223 | 5/1995 | Gatteschi | 242/552 X |
| 5,810,236 | 9/1998 | Yoshida et al. | 226/118.3 |

FOREIGN PATENT DOCUMENTS

| | | | |
|---|---|---|---|
| 0395029 | 10/1990 | European Pat. Off. | 242/417.2 |

*Primary Examiner*—Donald P. Walsh
*Assistant Examiner*—Minh-Chau Pham
*Attorney, Agent, or Firm*—Allen, Dyer, Doppelt, Milbrath & Gilchrist, P.A.

[57] ABSTRACT

An apparatus and methods are provided for dancingly controlling tension in a web of fabric such as for disposable garments. The apparatus preferably includes a dancer frame, a first set of a plurality of spaced-apart fabric guides connected to the dancer frame, a track connected to the dancer frame, and a tension yoke mounted for slidably following the he track. The tension yoke preferably includes a second set of a plurality of spaced-apart fabric guides positioned for slidably following the movement of the tension yoke when following the track. The apparatus also preferably includes a weight tension control assembly connected to the tension yoke for weightingly controlling the tension applied from the tension yoke to a web of fabric positioned thereon to thereby readily increase and decrease the tension applied to the web. A method of controlling tension in a web of fabric preferably includes positioning a web of fabric on first and second sets of a plurality of spaced-apart fabric guides, moving the web of fabric across the first and second sets of a plurality of spaced-apart fabric guides, and dancingly moving at least one set of the first and second sets of a plurality of fabric guides during movement of the web of fabric across the first and second sets of a plurality of spaced-apart fabric guides.

23 Claims, 7 Drawing Sheets

35
38
41
37
36
41
47
48

APPARATUS FOR CONTROLLING TENSION IN A WEB OF FABRIC AND ASSOCIATED METHODS

Field Of The Invention

The invention relates to the field of disposable products, and, more particularly, to laminating fabric for disposable garments.

BACKGROUND OF THE INVENTION

Fabric or layers of material are often formed, sealed, adhered, or positioned so as to overlie or underlie one another to thereby in combination form a laminate or laminated material. For laminating fabric, these layers often involve two rolls of fabric mounted or positioned to unwind so that the webs of material being unwound are combined in an overlying and/or underlying relationship to form a laminate fabric. These laminators when used in a production line, however, can have problems when one or more of the webs breaks, is damaged, or has problems associated with a smooth and continuous production line.

Additionally, tension control of moving webs of fabric is commonly monitored and controlled by the use of a dancer system. Many types of dancer systems have been developed over the years. A basic form of such a system, for example, includes a web of fabric being transported along a conveying system such as rollers, rolls, or conveyor belts being driven by motors. A dancer roll is preferably positioned in line with the conveying system so that the web passes over or engages the dancer roll. The dancer roll is preferably connected to a distal end of a dancer support arm and extends outwardly therefrom. The proximal end of the dancer support arm is preferably pivotally connected to a fixed position or mount so that the dancer roll "dances" or moves along the pivotal direction of the dancer support arm with the varying tension from the web, e.g., moving at different speeds, and thereby, in essence, follows the lead of the fabric web. This dancer system, however, also has several problems associated therewith. For example, the inertia of the dancer can cause the tension control to generally be non-linear with little dynamic response. In other words, when the dancer is being pulled up by the web of material positioned thereon, additional tension is required to start the dancer moving. This problem can become worse, for example, if the mass of the dancer is increased or the arm lengthens. Also, the dancer system provides little or no flexibility for readily adjusting tension within a system such as when a portion of a manufacturing line has problems or goes down.

SUMMARY OF THE INVENTION

In view of the foregoing background, the present invention advantageously provides an apparatus and methods for dancingly controlling the tension in fabric. The present invention also advantageously provides a dancer having increased tension control of and enhanced flexibility for controlling tension of moving webs of fabric. The present invention further advantageously provides an apparatus and methods for readily adjusting, e.g., increasing or decreasing, the tension supplied to a moving web of fabric and thereby increase the dynamic response for a manufacturing process.

An apparatus according to the present invention is provided for dancingly controlling tension in a web of fabric such as used for a disposable garment according to the present invention. The apparatus preferably includes a dancer frame, a plurality of spaced-apart fabric guides connected to the dancer frame and positioned to receive a web of fabric thereon, and fabric tension controlling means connected to the dancer frame for dancingly controlling the tension in the web of fabric during movement across the plurality of spaced-apart fabric guides.

According to an aspect of the present invention, the fabric tension controlling means of the apparatus, for example, can advantageously include a track connected to the dancer frame and a tension yoke mounted for slidably following the track. The tension yoke preferably also includes a plurality of spacedapart fabric guides positioned to receive the web of fabric and for slidably following the movement of the tension yoke when following the track. The fabric tension controlling means also preferably includes a weight tension control assembly connected to the tension yoke for weightingly controlling the tension applied from the tension yoke to the web of fabric positioned thereon. The tension yoke can advantageously include a yoke frame, and the weight tension control assembly can advantageously include a weight mounting member connected to the yoke frame for readily increasing and decreasing the weight of the tension yoke to thereby readily increase or decrease the tension in the web of fabric.

The present invention also provides a method of controlling tension in a web of fabric. The method preferably includes positioning a web of fabric on first and second sets of a plurality of spaced-apart fabric guides, moving the web of fabric across the first and second sets of a plurality of spaced-apart fabric guides, and dancingly moving at least one set of the first and second sets of a plurality of fabric guides during movement of the web of fabric across the first and second sets of a plurality of spaced-apart fabric guides.

The method can also advantageously include the dancingly moving step being provided by weightingly controlling the tension applied from at least one of the sets of fabric guides to the web of fabric positioned thereon. The step of weightingly controlling the tension preferably includes adjustably increasing the weight of at least one of the plurality of fabric guides of the at least one set of the first and second sets of a plurality of fabric guides which dancingly move to thereby increase the tension applied to the web of fabric. Also, the step of weightingly controlling the tension preferably includes adjustably decreasing the weight of at least one of the plurality of fabric guides of the at least one set of the first and second sets of a plurality of fabric guides which dancingly move to thereby decrease the tension applied to the web of fabric.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and single, double, and triple prime notation, where used, indicate similar elements in alternative embodiments.

Figure 1:
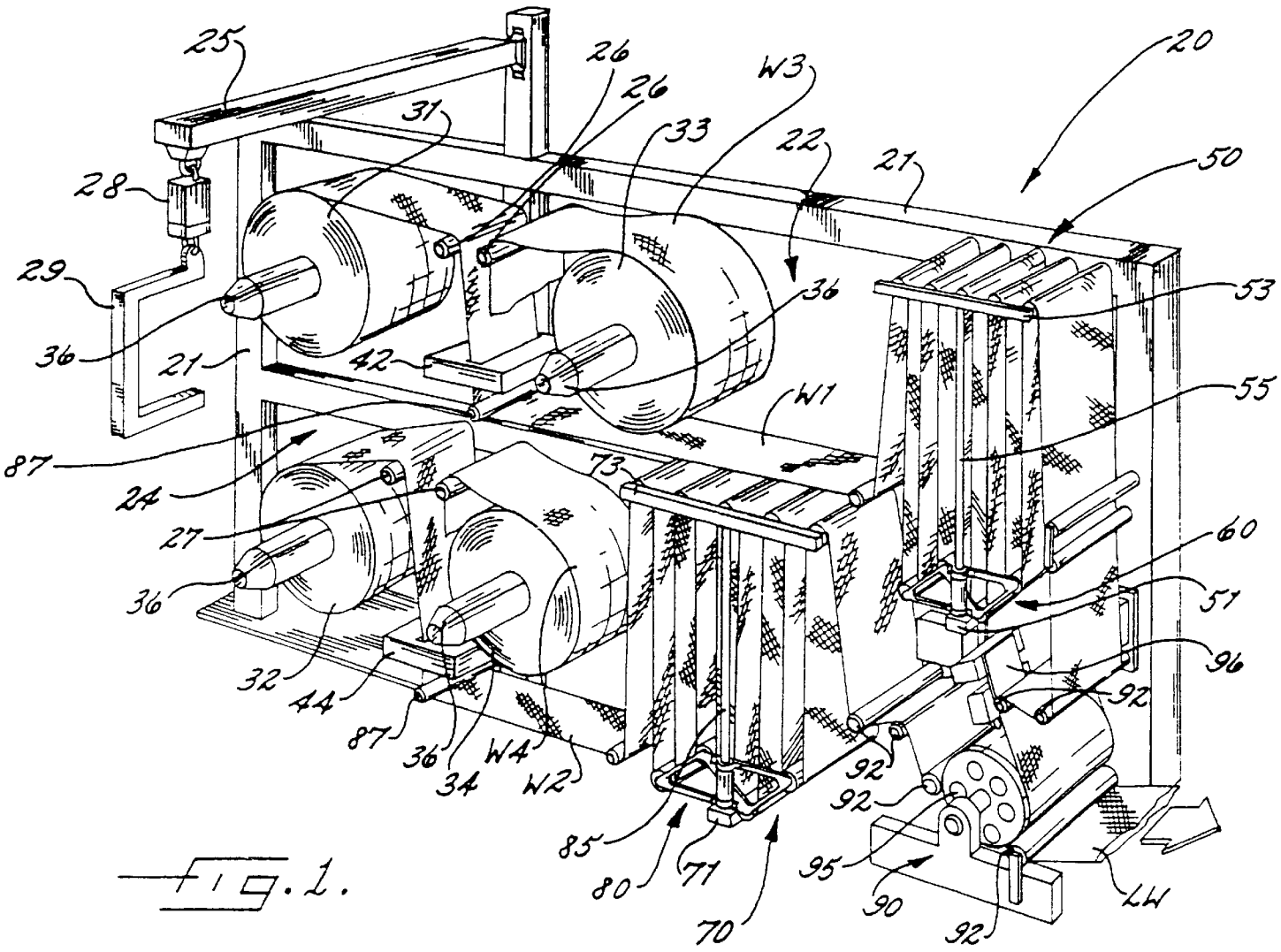
FIG. 1 is a perspective view of a first embodiment of a laminating apparatus having a pair of dancers and a plurality of air shaft assemblies according to the present invention.

FIG. 1 illustrates a laminating apparatus 20 for providing a laminated fabric or laminated web LW for a disposable garment such as a toddler brief, adult undergarment, or disposable diaper. The laminating apparatus 20 preferably includes a laminating frame 21 having upper 22 and lower 24 laminating frame regions. The frame 21, for example, can advantageously be mounted on a manufacturing floor or other generally horizontal support or floor support surface.

The laminating apparatus 20 also has a first roll 31 of fabric mounted to the upper laminating frame region 22 so as to provide a first web W1 of fabric when unwound from the first fabric roll 31. A second roll 32 of fabric is preferably mounted to the lower laminating frame region 24 and positioned adjacent the first fabric roll 31 so as to provide a second web W2 of fabric when unwound from the second fabric roll 32. A third redundant roll 33 of fabric also can advantageously be mounted to the upper laminating frame region 22 and positioned adjacent the first fabric roll 31 so as to provide a third web W3 of fabric when unwound from the third fabric roll 33. Likewise, a fourth redundant roll 34 of fabric advantageously can be mounted to the lower frame region 24 and positioned adjacent the second and third fabric rolls 32, 33 so as to provide a fourth web W4 of fabric when unwound from the fourth fabric roll 34.

The rolls 31, 32, 33, 34, and more particularly the first and third rolls 31, 33, can advantageously be mounted to the frame by the use of a lifting assembly which preferably includes a frame boom member 25 connected to and extending outwardly from the frame 21. A lift adjusting member 28 is preferably connected to the boom member 25 and cooperates with the boom member for adjusting and positioning the lift and placement of one of the rolls 31, 32, 33, 34. A roll engagement member 29 is preferably connected to the lift adjusting member 28 for engagement of one of the rolls 31, 32, 33, 34 when lifting a roll for mounting or dismounting from the frame 21.

Figure 2:
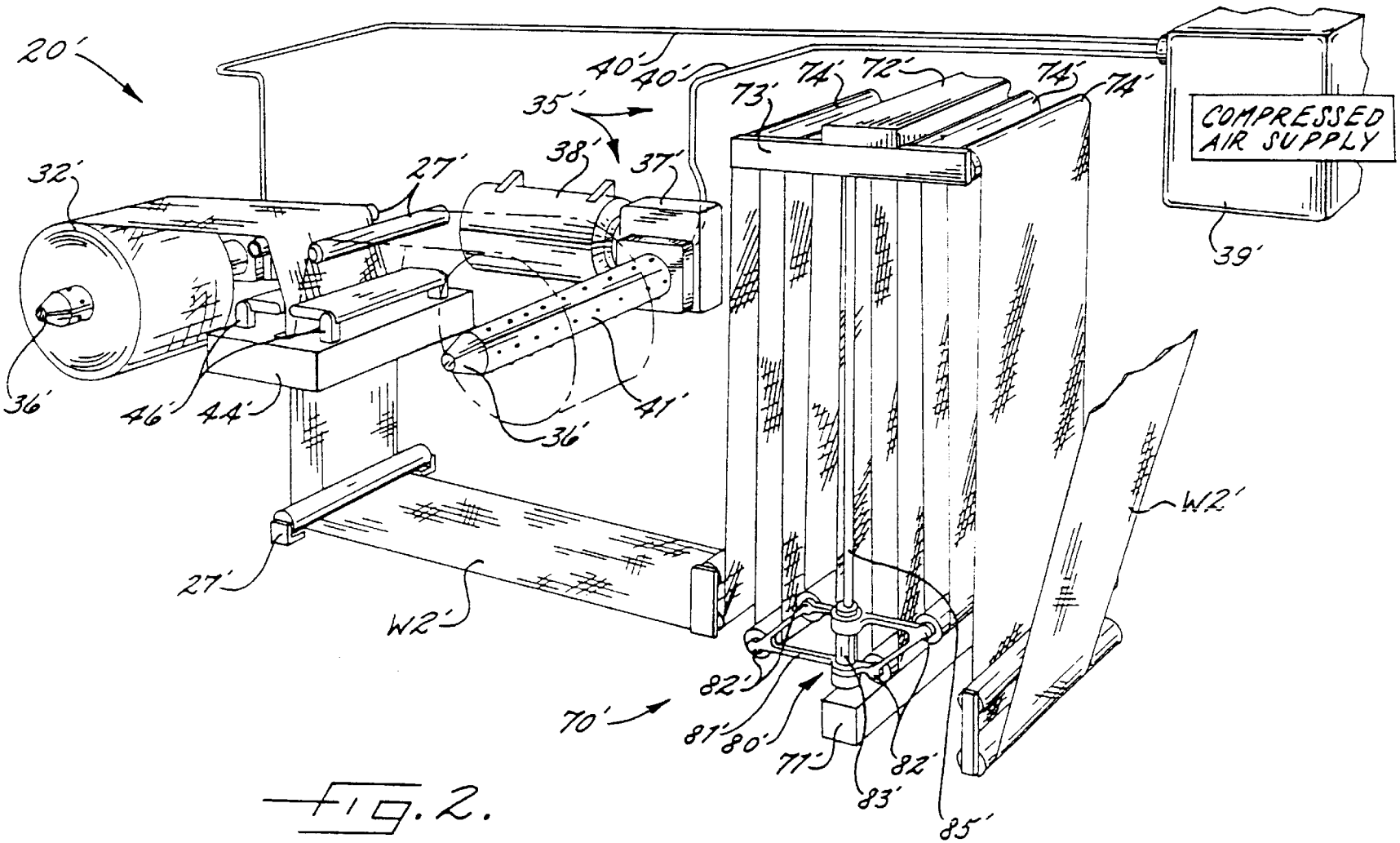
FIG. 2 is a perspective view of a portion of a second embodiment of a laminating apparatus having a dancer and a pair of air shaft assemblies according to the present invention.
Figure 8:
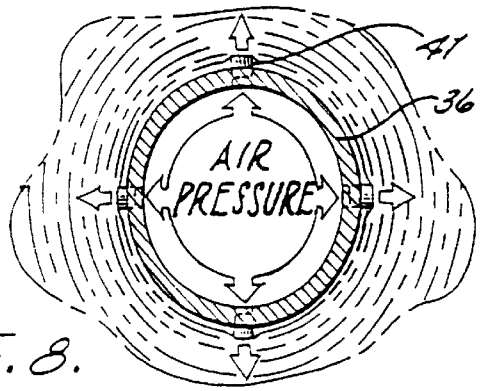
FIG. 8 is a sectional view of an air shaft assembly of a laminating apparatus taken along line 8—8 of FIG. 3 and illustrating air or gaseous pressure within an air shaft thereof according to an embodiment of the present invention.
Figure 6:
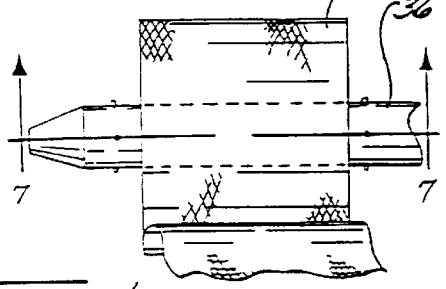
FIG. 6 is a side elevational view of an air shaft of a laminating apparatus having a roll of fabric mounted thereon for rotation according to an embodiment of the present invention.
Figure 7:
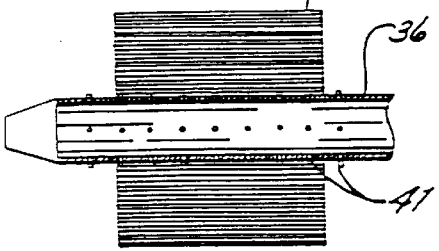
FIG. 7 is a sectional view of an air shaft of a laminating apparatus having a roll of fabric mounted thereon and taken along line 7—7 of FIG. 6 according to an embodiment of the present invention.
Figure 3:
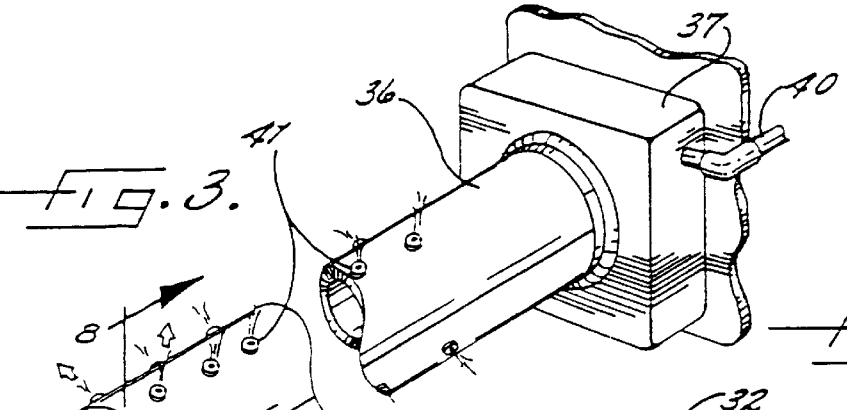
FIG. 3 is fragmentary perspective view of an air shaft assembly of a laminating apparatus according to an embodiment of the present invention.
Figure 4:
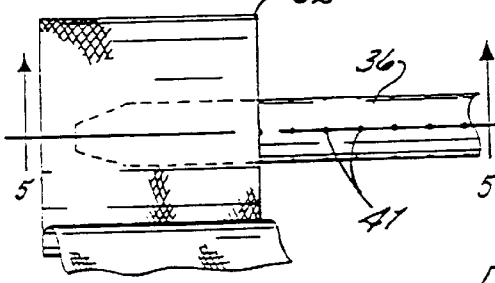
FIG. 4 is a side elevational view of an air shaft of a laminating apparatus having a roll of fabric being mounted thereon according to an embodiment of the present invention.
Figure 5:
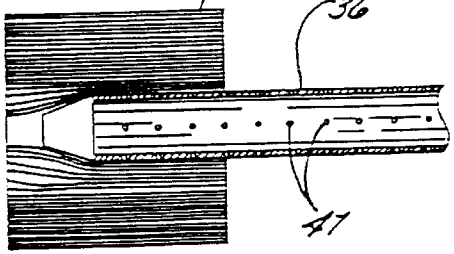
FIG. 5 is a sectional view of an air shaft of a laminating apparatus having a roll of fabric being mounted thereon and taken along line 5—5 of FIG. 4 according to an embodiment of the present invention.
Figure 9:
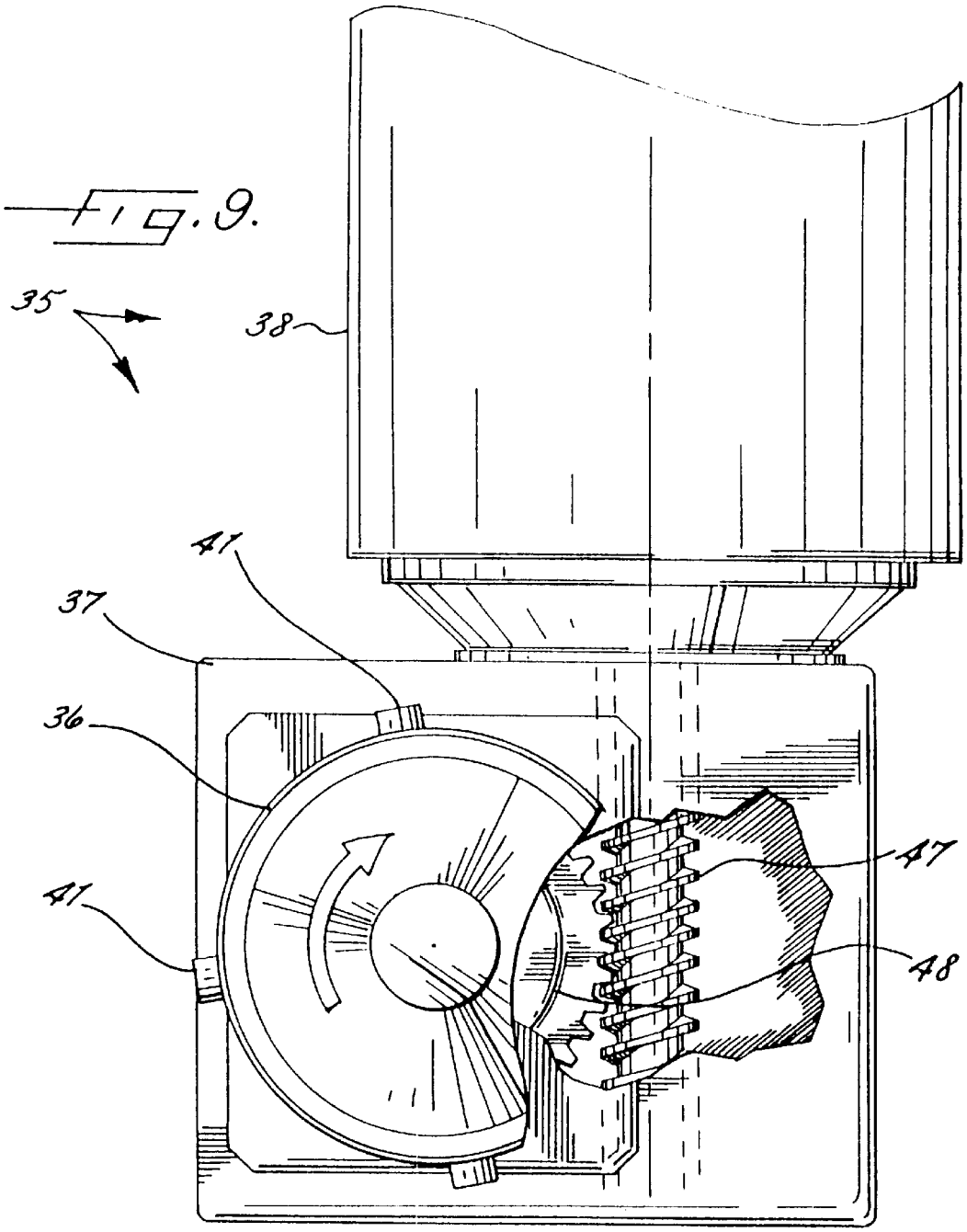
FIG. 9 is an enlarged side elevational view of an air shaft assembly of a laminating apparatus have portions thereof broken away for clarity according to an embodiment of the present invention.
Figure 10:
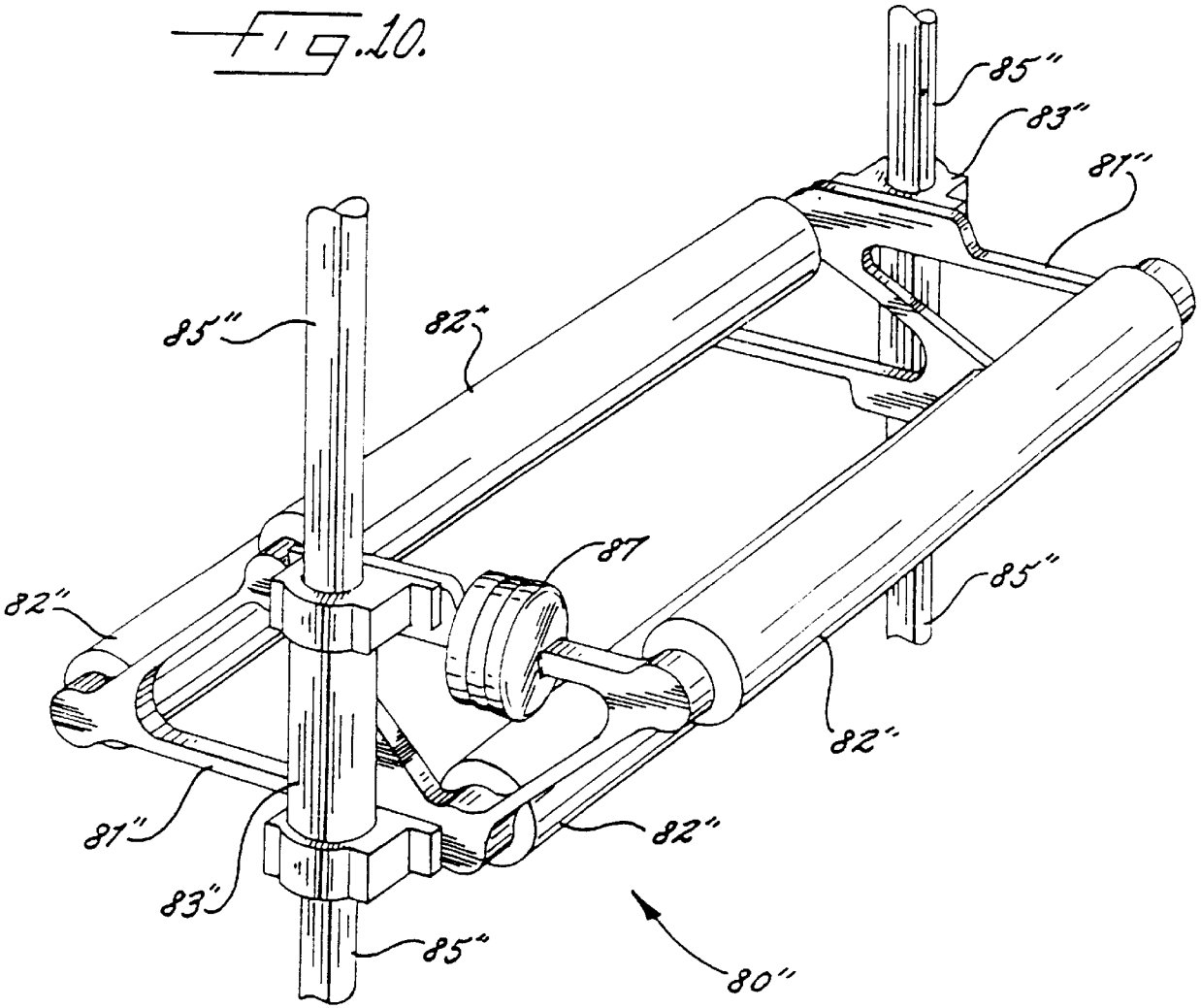
FIG. 10 is a fragmentary perspective view of a tension yoke of a dancer assembly of a laminating apparatus according to a third embodiment of the present invention.

As perhaps best illustrated in FIGS. 1–2, the laminating apparatus 20, 20' can additionally include a first splicer 42, as readily understood by those skilled in the art, mounted to the upper laminating frame region 22 for splicing the third web W3 of fabric to the first web W1 of fabric. A second splicer 44, 44' as readily understood by those skilled in the art, also is preferably mounted to the lower laminating frame region 24 for splicing the fourth web W4 of fabric to the second web W2 of fabric. For example, once the first or second rolls 31, 32 of fabric begin to diminish or come to an end thereof, the third and/or fourth fabric rolls 33, 34 can advantageously be spliced to the first and/or second fabric rolls 31, 32 so that little or no interruption or down time in the manufacturing process occurs. Accordingly, the first and/or second fabric rolls 31, 32 can then be replaced by the lifting assembly so that the first and/or second fabric rolls 31, 32 can then be respectively spliced to the third and fourth fabric rolls 33, 34. The fabric, for example, is preferably a non-woven material, but woven or other laminating materials can advantageously be used as well according to the present invention. The apparatus can also advantageously include a plurality of upper and lower auxiliary guide rolls 26, 27 connected to the frame for guiding the fabric downstream such as to a splicing assembly as illustrated and described further herein.

As illustrated in FIGS. 1–2 and 10–15, the laminating apparatus 20, 20', 20", 20"' also preferably includes fabric dance controlling means mounted to the laminating frame 21, positioned downstream from at least the first and second fabric rolls 31, 32, and preferably also downstream from the third and fourth fabric rolls 33, 34, and positioned to receive at least the first and second webs W1, W2 of fabric therefrom for dancingly controlling the tension of at least the first and second webs W1, W2 of fabric being received from at least the first and second fabric rolls 31, 32 and being supplied to fabric laminating means, e.g., preferably provided by a fabric laminator 90 as understood by those skilled in the art. The fabric laminator 90 is also preferably mounted to the laminating frame 21, positioned downstream from the fabric dance controlling means, and positioned to receive at least the first and second webs W1, W2 of fabric for combiningly laminating at least the first and second webs W1, W2 of fabric, and also preferably the third and fourth webs W3, W4 of fabric, to thereby provide a laminated web LW of fabric therefrom. The fabric laminator 90 preferably includes at least one draw roll 95 for drawing the webs of fabric from the rolls, i.e., through the dancer assemblies 50, 70 (see FIG. 1). The fabric laminator 90 preferably also includes a plurality of guide rollers 92 positioned for guiding the webs to and from the draw roll 95 and an adhesive applicator 96 for applying adhesive to at least one of the webs of fabric, e.g., directly or indirectly, so that the combined webs are drawn from or fed from the laminator 90 further downstream for use in disposable garments.

The fabric dance controlling means is preferably provided by one or more, and more preferably by at least two, dancer assemblies 50, 70 each positioned to receive one of the first and second webs W1, W2 of fabric for dancingly controlling tension in the respective one of the first and second webs W1, W2 of fabric. Each dancer assembly 50, 70, according to the present invention, preferably includes a dancer frame 51, 53, and 71, 72, 73, a plurality of spacedapart fabric guides 74 connected to the dancer frame 72, 73 and positioned to receive a web of fabric thereon, and fabric tension controlling means connected to the dancer frame 71, 72, 73 for dancingly controlling the tension in the web of fabric during movement across the plurality of spaced-apart fabric guides 74. The fabric tension controlling means preferably includes a track 55, 85, e.g., preferably provided by a pair of spaced-apart, elongate rods, connected to the dancer frame 71, 72, 73 and a tension yoke 60, 80 mounted for slidably following the track 55, 85. The tension yoke 80 preferably has a plurality of spaced-apart fabric guides 82 positioned to receive the web of fabric and for slidably following the movement of the tension yoke 80 when following the track 85. In other words, the tension yoke 80 preferably follows the lead of the web of fabric moving therethrough. The tension yoke 80' also preferably includes a yoke frame 81' to which the fabric guides, e.g., rollers 82', are mounted and a pair of track followers 83' connected to the yoke frame 81' and mounted to the track 85', e.g., for slidably moving along each of the pair of spaced-apart rods (see, e.g., FIG. 2).

The fabric tension controlling means can also advantageously include a weight tension control assembly connected to the tension yoke 80" for weightingly controlling the tension applied from the tension yoke 80" to the web of fabric positioned thereon. In one embodiment, the weight tension control assembly can advantageously include at least one pulley 88, a cable 89 connected to the tension yoke 80"' and engaging the at least one pulley 88, and a weight adjuster or mounting member 87' connected to the cable 89 so that when the weight is adjustedly increased, the tension provided to the web of fabric engaged by the tension yoke 80"' is increased and when the weight is adjustedly decreased, the tension provided a web of fabric engaged by the tension yoke 80"'. is decreased (see, e.g., FIG. 13). In an alternative embodiment, the weight tension control assembly can advantageously be connected more directly to the tension yoke 80" by having the weight adjuster or mounting member 87 be connected directly to and be integrally formed with a yoke frame 81" thereof (see, e.g., FIG. 10).

The dancer frame 71", 72", 73" preferably includes a pair of space-apart dancer frame members 71", 73", or 71", 72" and a frame support member 76". The pair of space-apart dancer frame members 71", 73", for example, can longitudinally extend generally parallel to each other (see, e.g., FIGS. 11–12) or can have one frame member 72" longitudinally extending in a first direction and a second one 71" longitudinally extending in a second direction (see, e.g., FIGS. 2 and 14). The track 85" is preferably connected to each of the pair of spaced-apart dancer frame members 71", 73", or 71", 72" and extends therebetween. The tension yoke 80" is preferably positioned to slidably follow the track 85" between the pair of spaced-apart dancer frame members 71", 73", or 71", 72".

Additionally, each of the plurality of spaced-apart fabric guides 74, 82 of the first and second sets includes at least one roller, and more particularly preferably a plurality of rollers 74, 82. The first set of a plurality of spaced-apart rollers 74 is connected to one of the parallel dancer frame members 73 and/or 72, and more preferably is fixedly connected in a non-moving position thereto. Accordingly, the plurality of rollers 82 of the tension yoke 80 preferably are fixedly mounted to the yoke frame 81, but slidably move with the movement of the tension yoke 80 along the track 85. Each of the at least two dancer assemblies 50, 70 further includes at least two spaced-apart rollers 78 positioned adjacent at least portions of the dancer frame 71, 72, 73. It will be understood by those skilled in the art that the second set of rollers 82 move with the movement of the tension yoke 80, but as also understood by those skilled in the art the first set of fabric guides or rollers 74 could move instead and the second set could be more stationarily mounted like the first set. Also, alternatively, all of or only portions of both sets of fabric guides could move as well according to the present invention.

Figure 13:
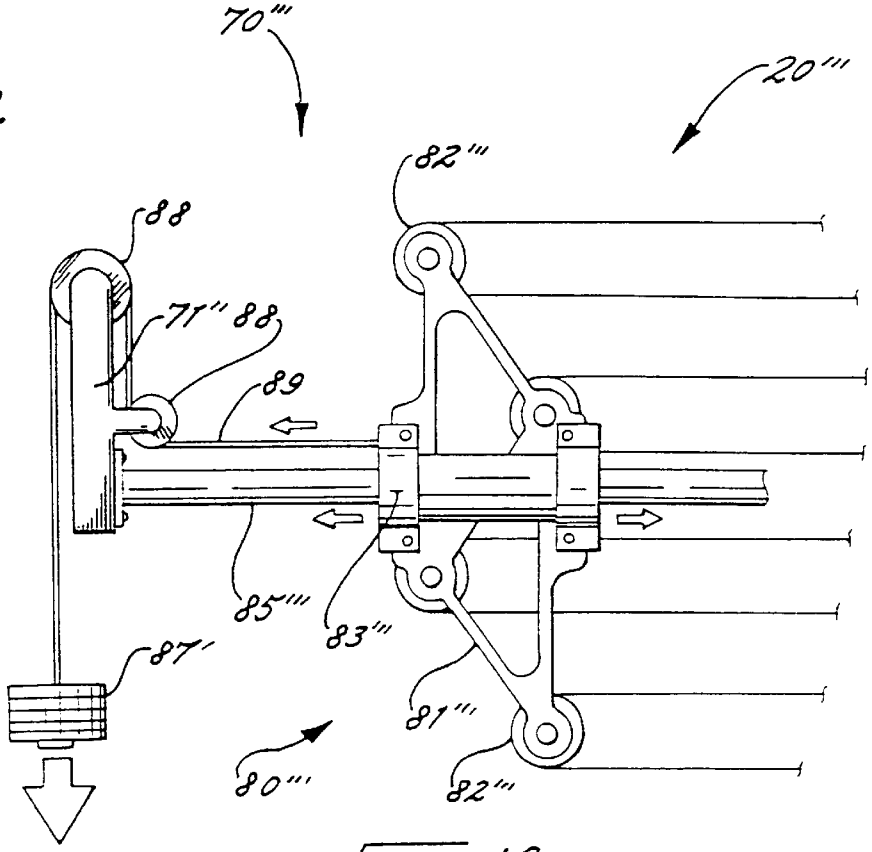
FIG. 13 is a fragmentary front elevational view of a horizontally oriented dancer assembly according to a fourth embodiment of the present invention.
Figure 12:
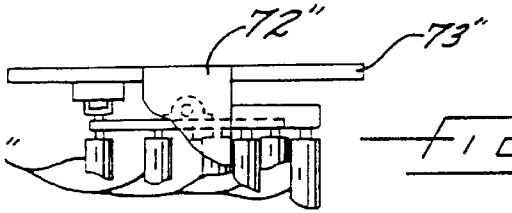
FIG. 12 is a fragmentary top plan view of a vertically oriented dancer assembly of a laminating apparatus according to a third embodiment of the present invention.
Figure 11:
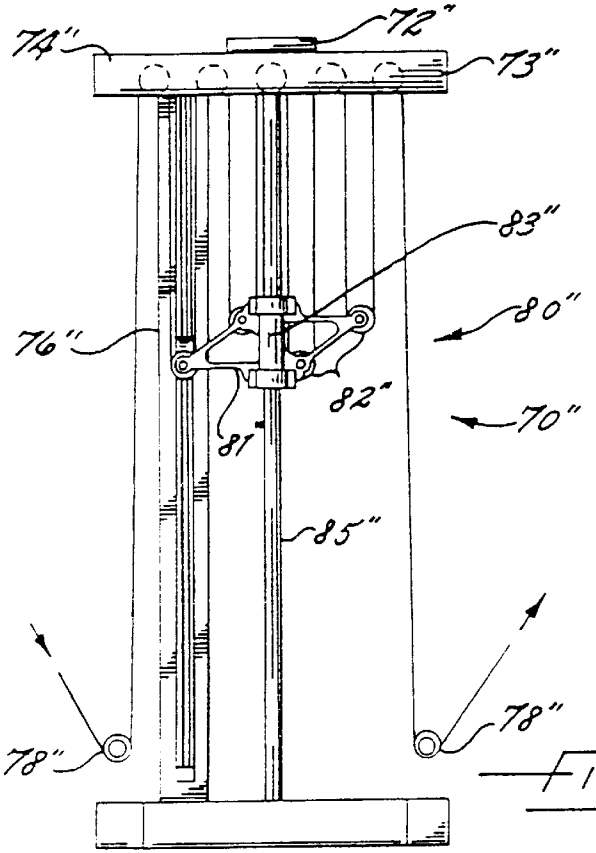
FIG. 11 is a front elevational view of a vertically oriented dancer assembly of a laminating apparatus according to a third embodiment of the present invention.

The generally parallel pair of spaced-apart dancer frame members 71, 73, or 71, 72 are also positioned generally parallel to a generally horizontally extending floor support surface which supports a frame 21 to which the apparatus 20 is mounted. Alternatively, as best illustrated in FIG. 13, the generally parallel pair of spaced-apart frame members 71, 73, or 71, 72 can be positioned to longitudinally extend in a plane transverse a generally horizontally extending floor support surface which supports a frame 21 to which the apparatus 20 is mounted.

Figure 15:
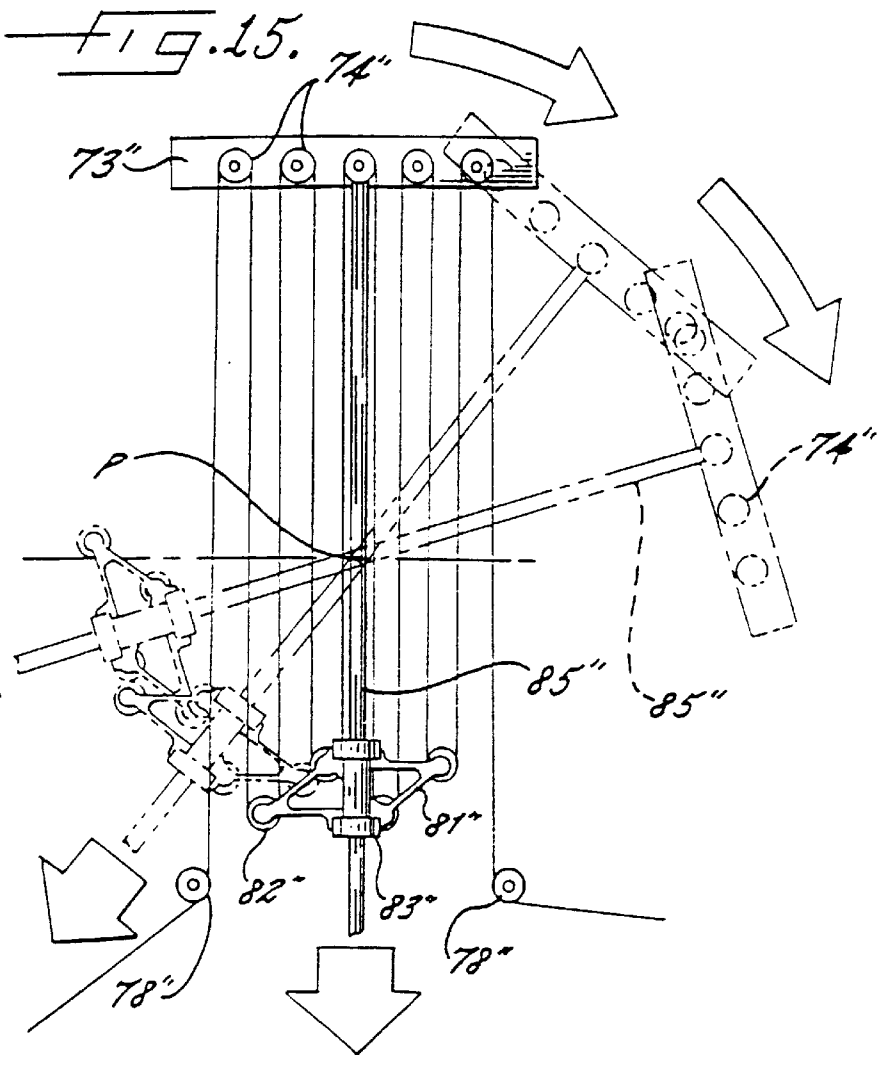
FIG. 15 is a front elevational view of a vertically oriented dancer assembly being rotatably mounted according to a third embodiment of the present invention.
Figure 14:
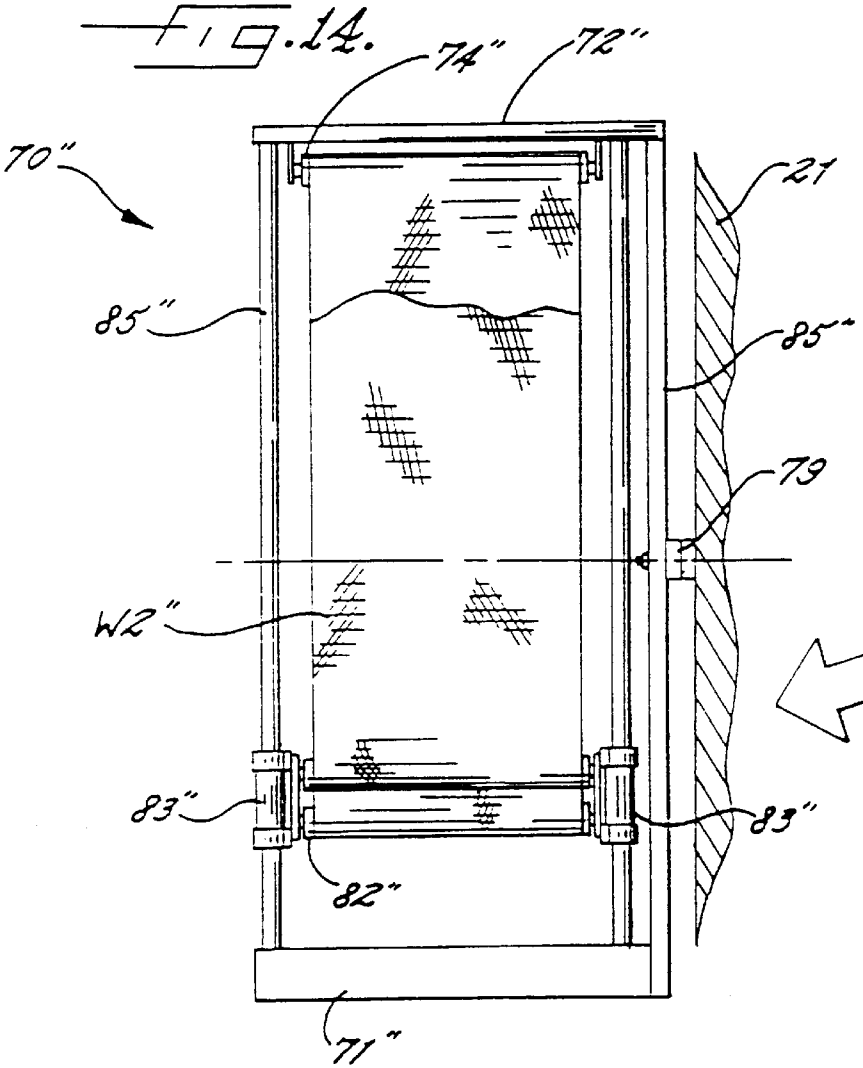
FIG. 14 is a side elevational view of a vertically oriented dancer assembly being rotatably mounted according to a third embodiment of the present invention.

Still another alternative, as best illustrated in FIGS. 14–15, is to have the frame or the plane of the movement of the yoke rotate. As illustrated in FIGS. 14–15, the assembly in this embodiment preferably includes means for rotating, e.g., a rotating assembly or pivoting assembly 79 (see FIG. 14) connected to a laminating frame wall 21 or other frame member to rotate the dancer frame or the yoke about a pivot point or rotating point P along a predetermined plane of rotation. The rotating means 79, for example, can include a ball and socket structure, a ball, screw, pin, and bearing structure such as illustrated and understood by those skilled in the art, a simple bolt structure, a slidable pivot and track structure, and/or other mechanical structures as understood by those skilled in the art to accomplish this rotating and/or pivoting movement to slightly incline or change the orientation of the frame or yoke to thereby increase the tension without substantially reducing the frequency response of the dancer assembly. Once the rotation has occurred, the dancer frame or yoke supporting structure is preferably secured in this position during movement of the fabric through the yoke. Instead of providing a counterweight, for example, this embodiment allows a slight rotation or incline in the assembly to occur to thereby increase tension.

Advantageously, the amount of weight can be changed as well with this embodiment of FIGS. 14–15 to increase or decrease the frequency response. A light weight fabric web, for example, can require a counterweight. This counterweight can advantageously be included and/or adjusted for in combination with rotation of the assembly as illustrated.

Because a conventional dancer system, for example, provides little dynamic response and the tension control is non-linear, the apparatus of the present invention even further lengthens the arm or moving unit which pivots as compared to the travel distance of the arm. By extending the arm past a fulcrum, a counter weight can be used to offset the mass of the dancer rolls. This can be set to provide low or zero pre-load in the static mode. Such a system can work well, for example, for controlling the foam used in diaper waistbands. The material feed rate is low and provides plenty of dynamic response. If desired, one or more potientiometers, as understood by those skilled in the art, can be used to provide feedback on the position of the dancer rolls to automate the control process. The potientiometers can also be in electrical communication with a controller, such as a microprocessor based control system as understood by those skilled in the art, so that enhanced control of the apparatus can be achieved.

As web velocities increase and the desired web tension decreases, in some types of conventional dancer systems for example, better control of the dancer system is desired. Because of the lack of dynamic response in the convention dancer systems, a conflict can arise between the desire for long arms which can provide better tangent zones or movement ranges. To increase the amount of stored material, the apparatus adds dancer rolls as illustrated. This also advantageously decreases the amount of the web tension, but increases the bearing drag and dancer mass. In turn, this leads to greater hysterisis and lower frequency response. The arc from the arm can cause the web roller angles to change and reduce linearity. The apparatus, however, addresses these problems by allowing the moving rolls to stay in a desired alignment such as illustrated. More importantly, however, the apparatus as illustrated preferably uses linear bearings as understood by those skilled in the art to increase web material storage, enhance web material stay at a desired angle, and provide multiple web paths to reduce web tension. The weight of the dancer rolls of the apparatus can advantageously be adjusted to provide the desired web tension. The frame members, as illustrated, also can advantageously be hollow, such as hollow shafts, to reduce dancer mass. This design, as illustrated, also advantageously provides offset rolls for strength as well.

Further, as perhaps best illustrated in FIGS. 2–9, a laminating apparatus 20 of the present invention preferably also includes a plurality of air shaft assemblies 35 connected to the laminating frame 21. Each of the plurality of air shaft assemblies 35 preferably includes a gear housing 37, at least one gear 47, 48 positioned in the gear housing 37, and an air shaft 36 rotatably mounted to the gear housing 37 and being positioned to mount one of the rolls 31, 32, 33, 34 of fabric thereon (see, e.g., FIG. 9). The rotatable air shaft 36 includes an elongate shaft rod body and a plurality of roll engagement members 41 slidably movable between a first retracted position when positioned substantially flush with the shaft rod body and a second extended position when positioned to extend outwardly from the shaft rod body and abuttingly contact an inner surface of a roll of fabric mounted thereon (see FIGS. 3–8). Also, each of the plurality of air shaft assemblies 35 also includes a motor 38 connected to the gear housing 37 for imparting rotary motion to the rotatable air shaft through the at least one gear, e.g., a worm-type gear 47 and a sprocket-type gear 48, positioned in the gear housing 37 and a gaseous supply, e.g., a compressed air supply 39, for supplying a gas to the air shaft through the air lines 40 during rotary movement of the shaft 36 to thereby enhance the engagement of the roll engagement members 41 with one of the rolls 31, 32, 33, 34 of fabric mounted thereon.

Other aspects of a laminating apparatus 20 are also described in co-pending patent application Ser. No. 09/089,777 by the same inventors filed on Jun. 3, 1998 and which is hereby incorporated herein by reference in its entirety.

As illustrated in FIGS. 1–15, the present invention also advantageously provides methods of laminating fabric for a disposable garment. A method preferably includes mounting a first roll 31 of fabric to a frame 21 so as to provide a first web W1 of fabric when unwound from the first fabric roll 31, mounting a second roll 32 of fabric to the frame 21 and positioned adjacent the first fabric roll 31 so as to provide a second web W2 of fabric when unwound from the second fabric roll 32, dancingly controlling the tension of at least one of the first and second webs W1, W2 of fabric being received from at least one of the first and second fabric rolls 31, 32, and combiningly laminating the first and second webs W1, W2 of fabric to thereby provide a laminated web LW of fabric. The dancingly controlling step can advantageously include providing at least one dancer assembly 50, 70 positioned to receive one of the first and second webs W1, W2 of fabric for dancingly controlling tension in the respective one of the first and second webs W1, W2 of fabric.

The method can also have the at least one dancer assembly 50, 70 including a dancer frame 71, 72, 73, a first set of a plurality of spaced-apart fabric guides 74 connected to the dancer frame 71, 72, 73, a track 85 connected to the dancer frame 71, 72, 73, and a tension yoke 80 mounted to the track 85. The method can further include slidably moving the tension yoke 80 to follow the track 85.

The method can further include weightingly controlling the tension applied from the tension yoke 80 to the web of fabric positioned thereon. The step of weightingly controlling the tension preferably includes adjustably increasing the weight of the tension yoke 80 to thereby increase the tension applied to the web of fabric. The step of weightingly controlling the tension can also include adjustably decreasing the weight of the tension yoke 80 to thereby decrease the tension applied to the web of fabric.

The method can still further include mounting a third redundant roll 33 of fabric to the frame 21 and positioned adjacent the first fabric roll 31 so as to provide a third web W3 of fabric when unwound from the third fabric roll 33, mounting a fourth redundant roll 34 of fabric to the frame 21 and positioned adjacent the second and third fabric rolls 32, 33 so as to provide a fourth web W4 of fabric when unwound from the fourth fabric roll 34, positioning a first splicer 42 on the frame 21 for splicing the third web W3 of fabric to the first web W1 of fabric, and positioning a second splicer 44 on the frame 21 for splicing the fourth web W4 of fabric to the second web W2 of fabric.

Another method of laminating fabric for a disposable garment according to the present invention preferably includes dancingly controlling the tension of at least one of first and second webs W1, W2 of fabric being received from at least one of respective first and second fabric rolls 31, 32 and combiningly laminating the first and second webs W1, W2 of fabric to thereby provide a laminated web LW of fabric therefrom.

This method can also advantageously have the dancingly controlling step including providing at least one dancer assembly 50, 70 positioned to receive one of the first and second webs W1, W2 of fabric for dancingly controlling tension in the respective one of the first and second webs W1, W2 of fabric and weightingly controlling the tension applied from the at least one dancer assembly 50, 70 to the web of fabric positioned thereon. The step of weightingly controlling the tension preferably includes adjustably increasing the weight of at least one fabric guide 82 engaging a portion of the web of fabric to thereby increase the tension applied to the web of fabric and adjustably decreasing the weight of at least one fabric guide 82 engaging the web of fabric to thereby decrease the tension applied to the web of fabric.

A method of controlling tension in a web of fabric is also provided according to the present invention. A method preferably includes providing at least one dancer assembly 50, 70 having first and second sets of a plurality of spaced-apart fabric guides 74, 82 positioned to receive a web of fabric thereon. The first set of fabric guides 74 is also preferably spaced-apart from the second set of fabric guides 82. The method further includes positioning a web of fabric on the first and second sets of a plurality of spaced-apart fabric guides 74, 82, moving the web of fabric across the first and second sets of a plurality of spaced-apart fabric guides 74, 82, and dancingly moving at least one set 82 of the first and second sets of a plurality of fabric guides 74, 82 during movement of the web of fabric across the first and second sets of a plurality of spaced-apart fabric guides 74, 82. The method can further include rotating the combination of the first and second sets of a plurality of spaced-apart fabric guides along a predetermined plane of rotation as illustrated (see FIG. 15) to thereby enhance the tension control of the web of fabric.

The method can also have the dancingly moving step including weightingly controlling the tension applied from the at least one dancer assembly 50, 70 to the web of fabric positioned thereon. The method can further include rotating the combination of the first and second sets of a plurality of spaced-apart fabric guides along a predetermined plane of rotation to thereby enhance the tension control of the web of fabric. The weightingly controlling of the tension can be provided by adjustably increasing the weight of at least one of the plurality of fabric guides 82 of the first and second sets of a plurality of fabric guides 74, 82 which dancingly move to thereby increase the tension applied to the web of fabric. The weightingly controlling the tension step can also advantageously include adjustably decreasing the weight of at least one of the plurality of fabric guides 82 of the first and second sets of a plurality of fabric guides 74, 82 which dancingly move to thereby decrease the tension applied to the web of fabric.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. An apparatus for dancingly controlling tension in a web of fabric, the apparatus comprising:

a dancer frame;

a first set of a plurality of spaced-apart fabric guides connected to the dancer frame;

a track connected to the dancer frame; and a tension yoke mounted for slidably following said track, said tension yoke including a second set of a plurality of spaced-apart fabric guides positioned for slidably following the movement of said tension yoke when following said track;

a weight tension control assembly connected to said tension yoke for weightingly controlling the tension applied from said tension yoke to a web of fabric positioned thereon.

2. An apparatus as defined in claim 1, wherein the dancer frame includes a pair of spaced-apart dancer frame members, said pair of spaced-apart dancer frame members longitudinally extending generally parallel to each other, said track being connected to each of said pair of spaced-apart dancer frame members and extending therebetween, said tension yoke being positioned to slidably follow said track between said pair of spaced-apart dancer frame members.

3. An apparatus as defined in claim 2, wherein each of said generally parallel pair of spaced-apart dancer frame members are also positioned generally parallel to a generally horizontally extending floor support surface which supports a frame to which the apparatus is mounted.

4. An apparatus as defined in claim 3, wherein each of said generally parallel pair of spaced-apart frame members is positioned to longitudinally extend in a plane transverse a generally horizontally extending floor support surface which supports a frame to which the apparatus is mounted.

5. An apparatus as defined in claim 2, wherein each of said plurality of spaced-apart fabric guides of said first and second sets includes at least one roller, said first set of a plurality of spaced-apart rollers being connected to only one of said parallel dancer frame members, and wherein each of at least two dancer assemblies includes at least two spaced-apart rollers positioned adjacent the dancer frame.

6. An apparatus as defined in claim 1, wherein said tension yoke includes a yoke frame, and wherein said weight tension control assembly includes a weight mounting member connected to said yoke frame for increasing and decreasing the weight of said tension yoke.

7. An apparatus as defined in claim 1, wherein said weight tension control assembly includes at least one pulley, a cable connected to said tension yoke and engaging said at least one pulley, and a weight adjuster connected to said cable so that when the weight is adjustedly increased, the tension provided to a web of fabric engaged by said tension yoke is increased and when the weight is adjustedly decreased, the tension provided a web of fabric engaged by said tension yoke is decreased.

8. An apparatus as defined in claim 1, further comprising yoke rotating means connected to said tension yoke for rotating said tension yoke about a predetermined plane of rotation to enhance tension control of a web of fabric positioned on said tension yoke.

9. An apparatus for dancingly controlling tension in a web of fabric, the apparatus comprising:

a dancer frame;

a plurality of spaced-apart fabric guides connected to the dancer frame and positioned to receive a web of fabric thereon; and fabric tension controlling means connected to the dancer frame for dancingly controlling the tension in the web of fabric during movement across the plurality of spaced-apart fabric guides, said means including a track connected to the dancer frame, a tension yoke mounted for slidably following said track, said tension yoke also including a plurality of spaced-apart fabric guides positioned to receive the web of fabric and for slidably following the movement of said tension yoke when following said track, and a weight tension control assembly connected to said tension yoke for weightingly controlling the tension applied from said tension yoke to the web of fabric positioned thereon.

10. An apparatus as defined in claim 9 wherein said weight tension control assembly includes at least one pulley, a cable connected to said tension yoke and engaging said at least one pulley, and a weight adjuster connected to said cable so that when the weight is adjustedly increased, the tension provided to the web of fabric engaged by said tension yoke is increased and when the weight is adjustedly decreased, the tension provided a web of fabric engaged by said tension yoke is decreased.

11. An apparatus as defined in claim 9, further including a generally parallel pair of spaced-apart dancer frame members positioned generally parallel to a generally horizontally extending floor support surface which supports a frame to which the apparatus is mounted.

12. An apparatus as defined in claim 9, further including a pair of spaced-apart dancer frame members positioned to longitudinally extend in a plane transverse a generally horizontally extending floor support surface which supports a frame to which the apparatus is mounted.

13. An apparatus as defined in claim 9, wherein the dancer frame includes a pair of spaced-apart dancer frame members, said pair of spaced-apart dancer frame members longitudinally extending generally parallel to each other, said track being connected to each of said pair of s paced-apart dancer frame members and extending therebetween, said tension yoke being positioned to slidably follow said track between said pair of spaced-apart dancer frame members.

14. An apparatus as defined in claim 13, wherein each of said plurality of spaced-apart fabric guides of said first and second sets includes at least one roller, said first set of a plurality of spaced-apart rollers being connected to only one of said parallel dancer frame members, and further including at least two dancer assemblies each having at least two spaced-apart rollers positioned adjacent the dancer frame.

15. An apparatus as defined in claim 9, wherein said fabric tension controlling means further comprises yoke rotating means connected to said tension yoke for rotating said tension yoke about a predetermined plane of rotation to enhance tension control of a web of fabric positioned on said tension yoke.

16. A method of controlling tension in a web of fabric, the method comprising the steps of:

providing at least one dancer assembly having first and second sets of a plurality of spaced-apart fabric guides positioned to receive a web of fabric thereon, the first set of fabric guides also being spaced-apart from the second set of fabric guides;

positioning a web of fabric on the first and second sets of a plurality of spaced-apart fabric guides;

moving the web of fabric across the first and second sets of a plurality of spaced-apart fabric guides; and weightingly controlling the tension applied from said dancer assembly to the web of fabric positioned thereon while dancingly moving at least one set of the first and second sets of a plurality of fabric guides during movement of the web of fabric across the first and second sets of a plurality of spaced-apart fabric guides.

17. A method as defined in claim 16, wherein the step of weightingly controlling the tension includes adjustably increasing the weight of at least one of the plurality of fabric guides of the at least one set of the first and second sets of a plurality of fabric guides which dancingly move to thereby increase the tension applied to the web of fabric.

18. A method as defined in claim 16, wherein the step of weightingly controlling the tension includes adjustably decreasing the weight of at least one of the plurality of fabric guides of the at least one set of the first and second sets of a plurality of fabric guides which dancingly move to thereby decrease the tension applied to the web of fabric.

19. A method as defined in claim 16, further comprising rotating the combination of the first and second sets of a plurality of spaced-apart fabric guides along a predetermined plane of rotation to thereby enhance the tension control of the web of fabric.

20. A method of controlling tension in a web of fabric, the method comprising the steps of:

positioning a web of fabric on first and second sets of a plurality of spaced-apart fabric guides;

moving the web of fabric across the first and second sets of a plurality of spaced-apart fabric guides; and weightingly controlling the tension applied from at least one of the sets of fabric guides to the web of fabric positioned thereon while dancingly moving at least one set of the first and second sets of a plurality of fabric guides during movement of the web of fabric across the first and second sets of a plurality of spaced-apart fabric guides.

21. A method as defined in claim 20, further comprising rotating the combination of the first and second sets of a plurality of spaced-apart fabric guides along a predetermined plane of rotation to thereby enhance the tension control of the web of fabric.

22. A method as defined in claim 21, wherein the step weightingly controlling the tension includes adjustably increasing the weight of at least one of the plurality of fabric guides of the at least one set of the first and second sets of a plurality of fabric guides which dancingly move to thereby increase the tension applied to the web of fabric.

23. A method as defined in claim 20, wherein the step of weightingly controlling the tension includes adjustably decreasing the weight of at least one of the plurality of fabric guides of the at least one set of the first and second sets of a plurality of fabric guides which dancingly move to thereby decrease the tension applied to the web of fabric.

* * * * *

UNITED STATES PATENT AND TRADEMARK OFFICE

CERTIFICATE OF CORRECTION

PATENT NO. : 6,012,669

DATED : January 11, 2000

INVENTOR(S) : THARPE, JR. ET AL..

It is certified that error appears in the above-identified patent and that said Letters Patent is hereby corrected as shown below:

| | |
|---|---|
| On the cover page Line 7 of the Abstract | Strike: "he" |
| Column 2, line 11 | Strike: "spacedapart"<br>Insert: - - spaced-apart - - |
| Column 5, line 19 | Strike: "spacedapart"<br>Insert: - - spaced-apart - - |
| Column 5, line 53 | Strike: "**80'"**."<br>Insert: - - **80'"** - - |

UNITED STATES PATENT AND TRADEMARK OFFICE

CERTIFICATE OF CORRECTION

PATENT NO. : 6,012,669

DATED : January 11, 2000

INVENTOR(S) : Tharpe, et al

It is certified that error appears in the above-identified patent and that said Letters Patent is hereby corrected as shown below:

| | |
|---|---|
| Column 5, line 60 | Strike: "space-apart"<br>Insert: - - spaced-apart - - |
| Column 5, line 61 | Strike: "space-apart"<br>Insert: - - spaced-apart - - |
| Column 11, lines 22-23 | Strike: "s paced-apart"<br>Insert: - - spaced-apart - - |

Signed and Sealed this

Seventeenth Day of October, 2000

*Attest:*

Q. TODD DICKINSON

*Attesting Officer*

*Director of Patents and Trademarks*